US007104162B1

(12) United States Patent
Wu

(10) Patent No.: US 7,104,162 B1
(45) Date of Patent: Sep. 12, 2006

(54) DEVICE FOR UNFASTENING PIPE FASTENERS

(76) Inventor: Pi-Liang Wu, P.O. Box 55-124, Taichung (TW)

( * ) Notice: Subject to any disclaimer, the term of this patent is extended or adjusted under 35 U.S.C. 154(b) by 0 days.

(21) Appl. No.: 11/265,286

(22) Filed: Nov. 3, 2005

(30) Foreign Application Priority Data

Aug. 17, 2005 (TW) ..... 94214050 U

(51) Int. Cl.
*B25B 27/10* (2006.01)

(52) U.S. Cl. ..... 81/9.3; 81/3.07; 81/3.36

(58) Field of Classification Search ..... 81/3.07, 81/3.36, 9.3

See application file for complete search history.

(56) References Cited

U.S. PATENT DOCUMENTS 3,596,686 A * 8/1971 Blumenfeld et al. ..... 81/93

* cited by examiner

*Primary Examiner*—Lee D. Wilson
*Assistant Examiner*—Shantese L. McDonald

(57) ABSTRACT

An unfastening device for unfastening pipe fasteners includes a base and a first clamp plate extends from a top of an end of the base. A movable member is slidably mounted to the base and movable between the two ends of the base. A second clamp plate and a third clamp plate extend from a top of the movable member. A cable unit includes a head which extends through one of two ends of the base and is stopped by an end of the movable member. A flexible cable extends through the head and has a first end fixed to the first board of the base. By pulling the second end of the flexible cable, the movable member is moved along the base and the distance between the first clamp plate and the second and third clamp plates can be adjusted.

7 Claims, 7 Drawing Sheets

DEVICE FOR UNFASTENING PIPE FASTENERS

FIELD OF THE INVENTION

The present invention relates to a device for unfastening pipe fasteners and includes multiple clamp plates to unfasten the fasteners of different sizes.

BACKGROUND OF THE INVENTION

A conventional pipe fastener 1 is shown in FIG. 1 and generally includes a slot 101 defined through a first end 103 thereof and a second end 102 of the fastener 1 extends through the slot 101 so as to fasten a hose to a connector (both not shown). When unfastening the fastener 1, a tool 2 as shown in FIG. 2 is used which is cooperated with a device 4 to separate the first and second ends 102, 103 to loosen the fastener 1. The tool 2 includes two handles pivotably connected with each other and a cable unit 3 has one end fixed to one protrusion extending from one of the two handles and the other end of the cable unit 3 is connected to the device 4 which is operated by pivoting the two handles toward each other. The device 4 can reach a deep and narrow space to unfasten the target fastener. The device 4 includes a base 401 and a movable member 402 is slidably mounted to the base 401. A fixed plate 404 extends from an end of the base 401 and a movable plate 405 extends from the movable member 402. By pulling the cable unit 3, the movable member 402 is moved relative to the base 401 so as to adjust the distance between the fixed plate 404 and the movable plate 405 to separate the first and second ends 103, 102 of the fastener 1. Nevertheless, the distance between the fixed plate 404 and the movable plate 405 is fixed when the cable unit 3 is not yet pulled, so that if the distance between the first and second ends 103, 102 of a fastener 1 is smaller than the distance between the fixed plate 404 and the movable plate 405 is fixed when the cable unit 3 is not yet pulled, the device 4 is useless. In other words, the user has to prepare a plurality of devices with different distances between the fixed plate 404 and the movable plate 405 so as to unfasten the fasteners 1 of different sizes.

The present invention intends to provide an unfastening device for unfastening fasteners that includes several pairs of clamp plates so that the device is able to deal with a wide range of distance between the two ends of fasteners.

SUMMARY OF THE INVENTION

The present invention relates to an unfastening device for unfastening pipe fasteners and the device comprises a base and a first clamp plate extends from a top of a first end of the base. A movable member is slidably mounted to the base and movable between the first and second ends of the base. A second clamp plate and a third clamp plate extend from a top of the movable member. A cable unit includes a head which extends through the second board and is stopped by an end of the movable member. A flexible cable extends through the head and has a first end fixed to the first board of the base.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
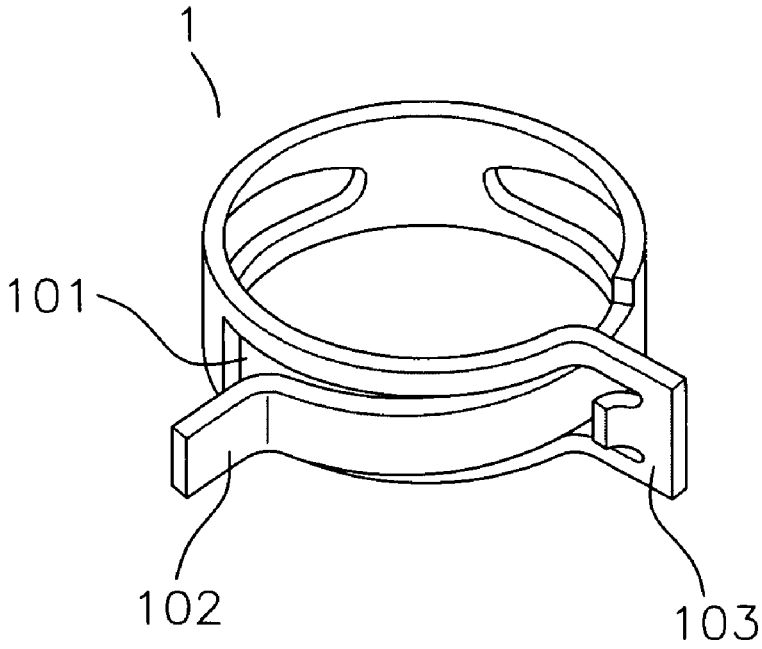
FIG. 1 PRIOR ART
FIG. 1 is a perspective view to show a pipe fastener.
Figure 3:
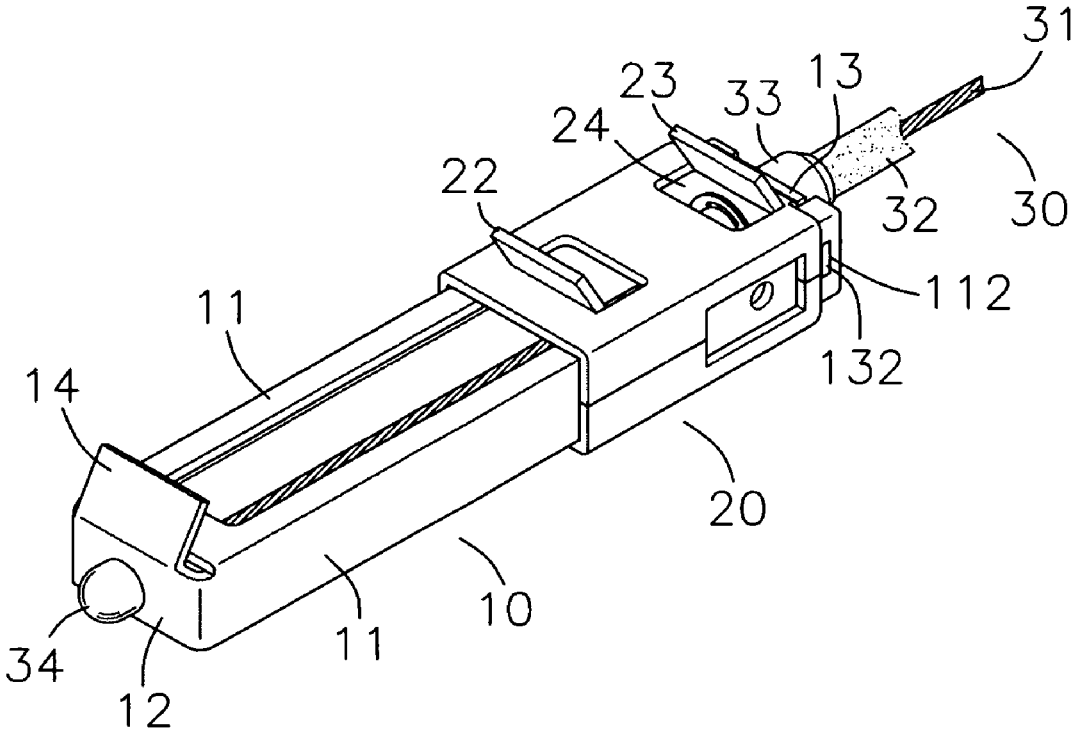
FIG. 3 is a perspective view to show the unfastening device of the present invention.
Figure 2:
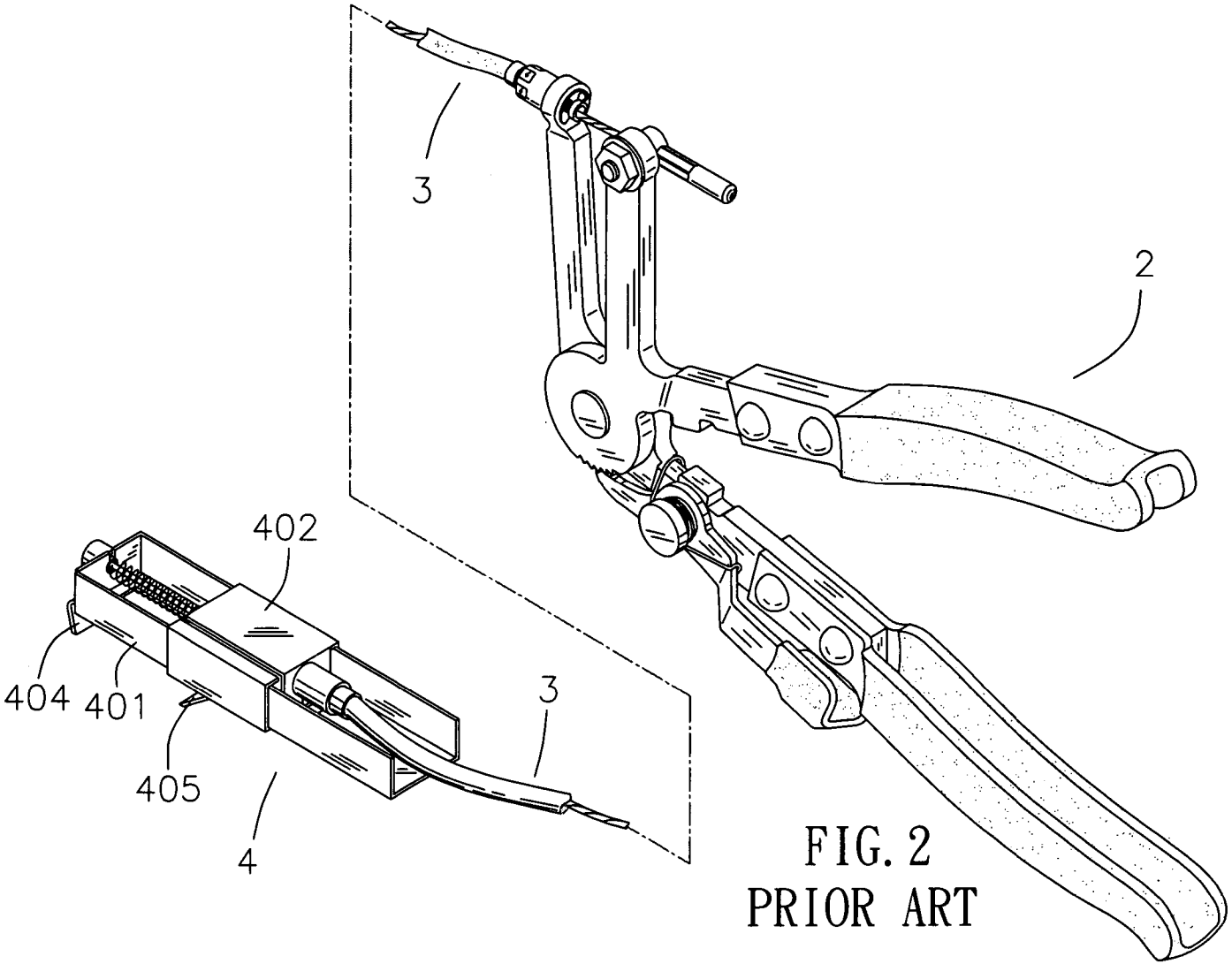
FIG. 2 PRIOR ART
FIG. 2 shows a conventional pipe fastener unfastening device cooperated with a tool.
Figure 4:
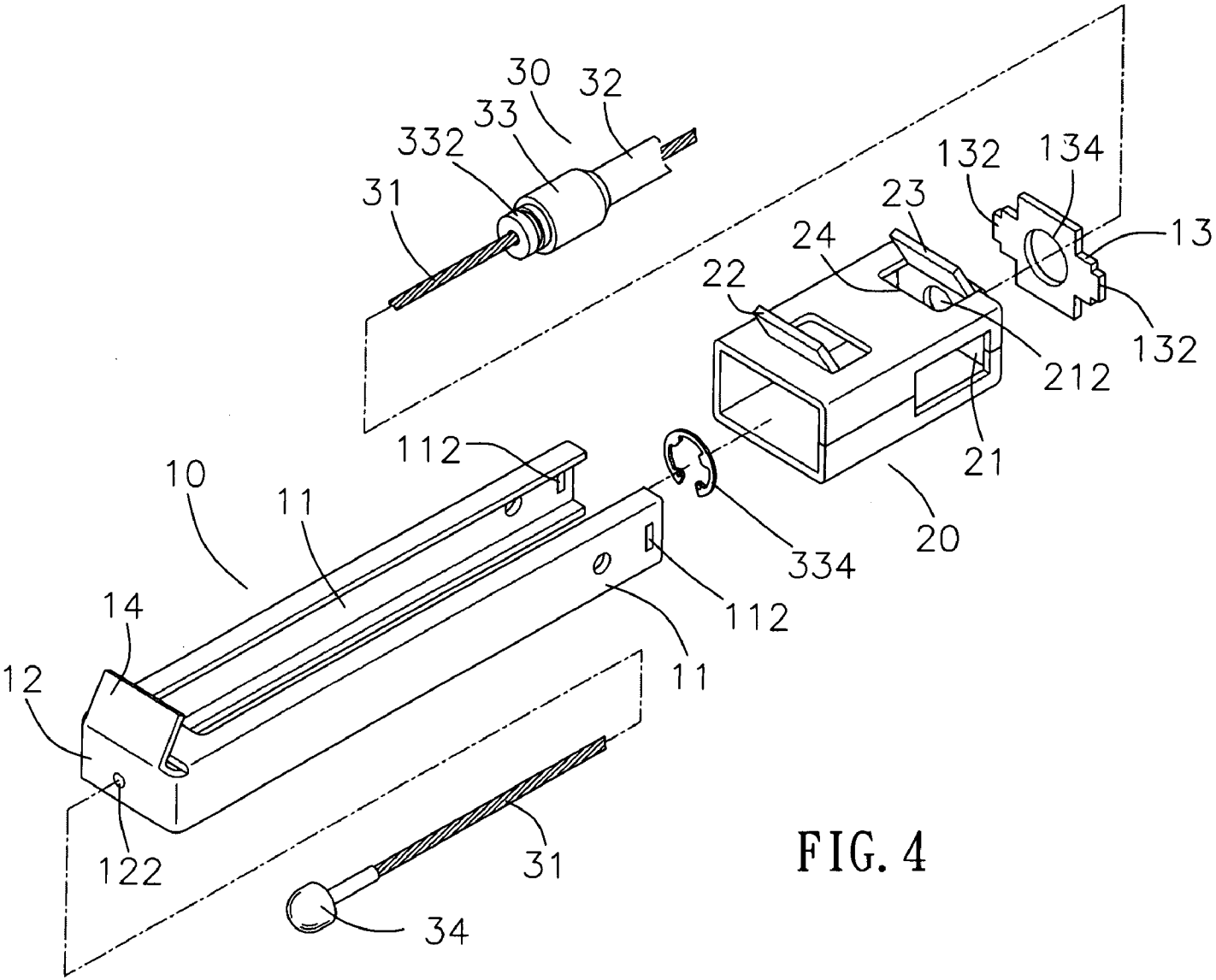
FIG. 4 is an exploded view to show the unfastening device of the present invention.
Figure 5:
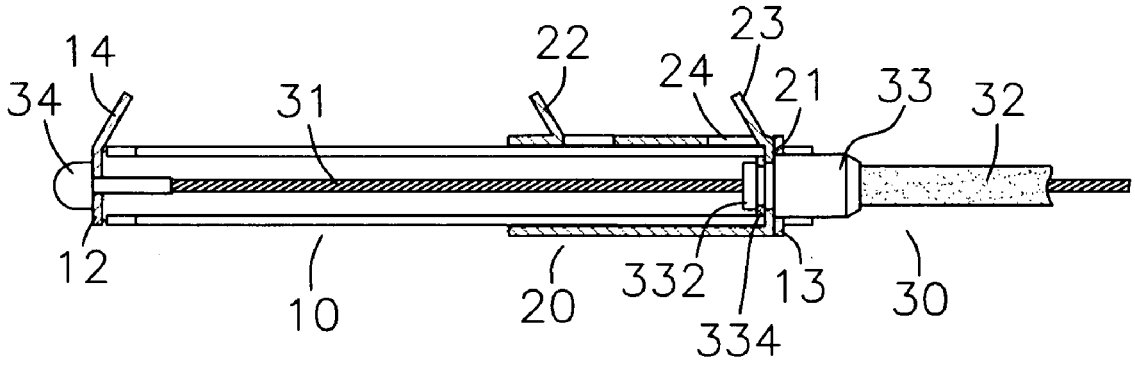
FIG. 5 is a side cross sectional view to show the unfastening device of the present invention.

Referring to FIGS. 3 to 5, the unfastening device of the present invention comprises a base 10 which is composed of a first board 12, a second board 13 and two sidewalls 11 which are connected between the first and second end boards 12, 13. A first clamp plate 14 extends from a top of a first end of the base 10 and a hole 122 is defined through the first board 12. The second board 13 includes two protrusions 132 on two sides thereof and the sidewalls 11 of the base 10 have two slots 12 through which the two protrusions 132 extend. The second board 13 has a central hole 134.

A movable member 20 is slidably mounted to the base 10 and movable between the first and second boards 12, 13 of the base 10. A second clamp plate 22 and a third clamp plate 23 extend from a top of the movable member 20. Two apertures 24 are defined in a top of the movable member 20 and respectively located close to the second and third clamp plates 22, 23.

A cable unit 30 includes a head 33 and an insertion 332 extends axially from the head 33 and extends through the central hole 134 of the second board 13 and a hole 212 defined in an end 21 of the movable member 20. A C-shaped clip 334 is mounted to the insertion 332 to position the insertion 332 to the end 21 of the movable member 20. The head 33 is stopped by the end 21 of the movable member 20. A flexible cable 31 extends through the head 33 and has a first end extends through the hole 122 in the first board 12 and connected to a stop member 34 so that the first end of the flexible cable 31 is fixed to the first board 12 of the base 10. The second end of the flexible cable 31 is enclosed by a sheath 32 and can be connected to a tool which is not shown.

Figure 6:
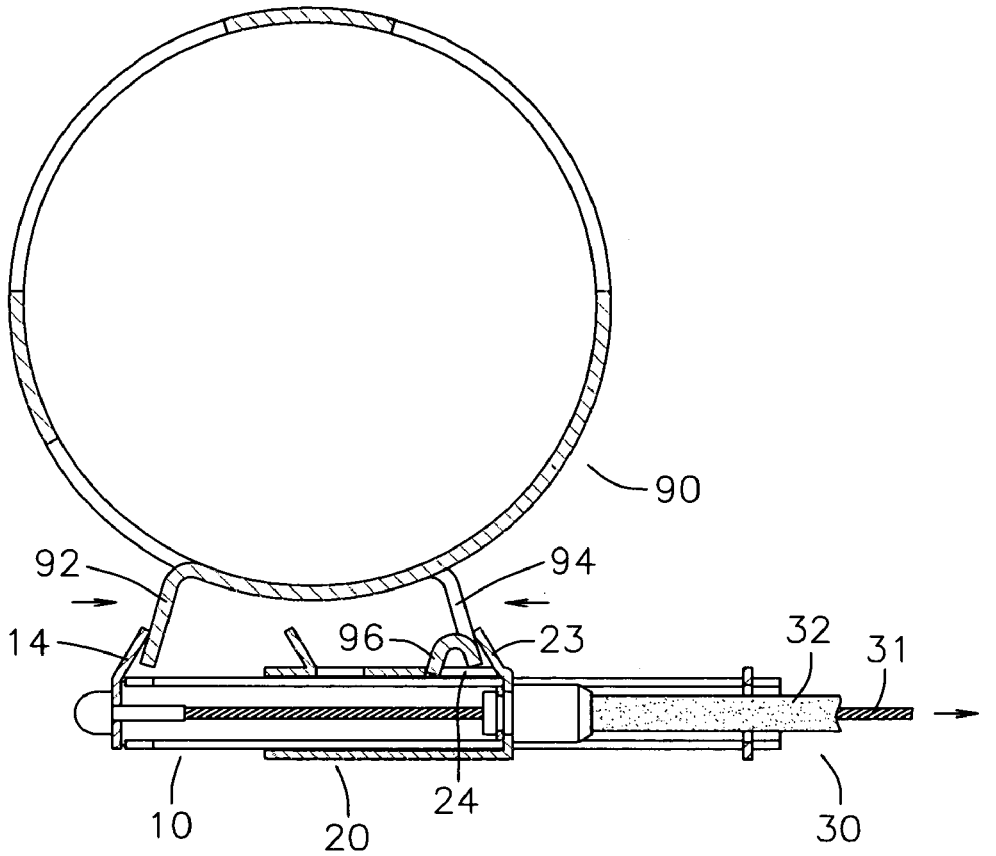
FIG. 6 shows the unfastening device of the present invention is used to unfasten a fastener wherein a distance between the two ends of the fastener is wide.
Figure 7:
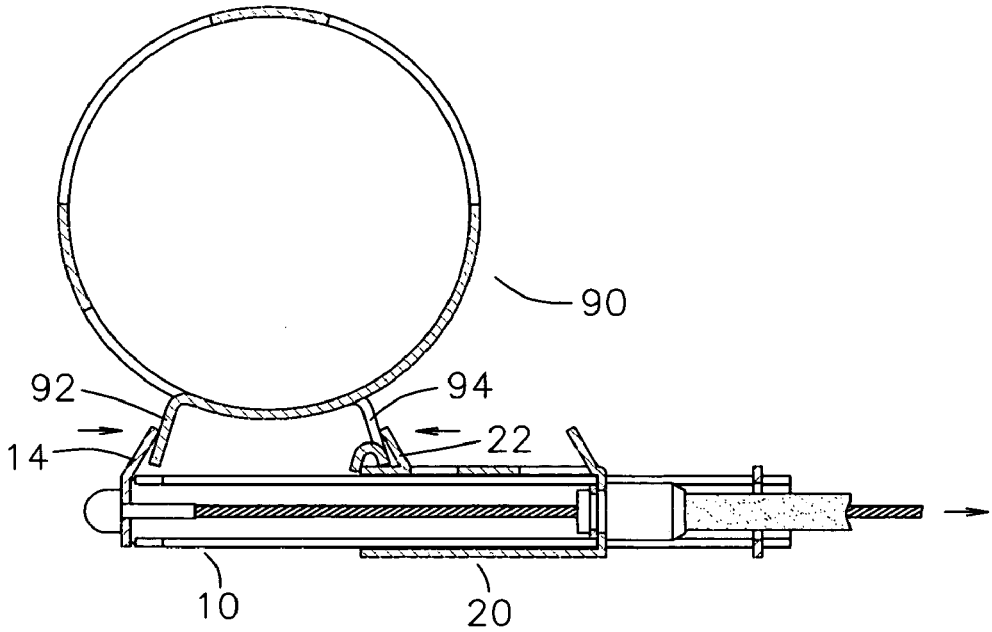
FIG. 7 shows the unfastening device of the present invention is used to unfasten a fastener wherein a distance between the two ends of the fastener is short.

As shown in FIGS. 6 and 7, when a distance between two ends 92, 94 of a fastener 90 is wide as shown in FIG. 6, the user may arrange the device so that the first clamp plate 14 and the third clamp plate 23 are respectively located at outsides of the two ends 92, 94. The second end of the flexible cable 31 is then pulled to move the base 10 relative to the movable member 20 to move the two ends 92, 94 toward each other to unfasten the fastener. A protrusion 96 of the end 94 can be inserted into the aperture 24 close to the third clamp plate 23 so that the protrusion 96 does not interrupt the operation. If the distance between the two ends 92, 94 are short, the first clamp plate 14 and the second clamp plate 22 are then arranged to be located on outsides of the two ends 92, 94 to unfasten the fastener.

Figure 8:
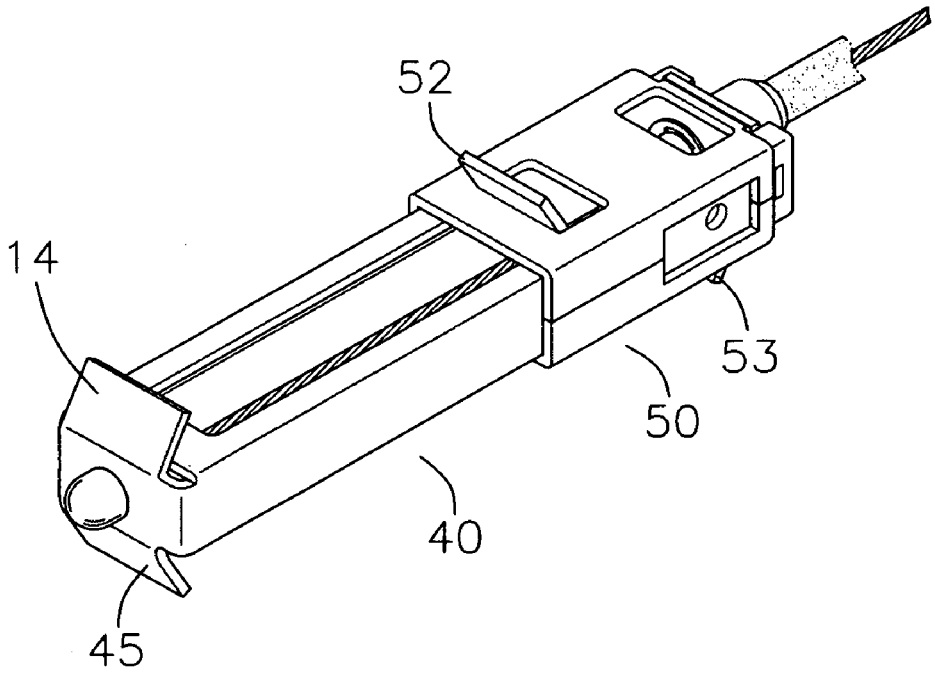
FIG. 8 is a perspective view to show another embodiment of the unfastening device of the present invention.
Figure 9:
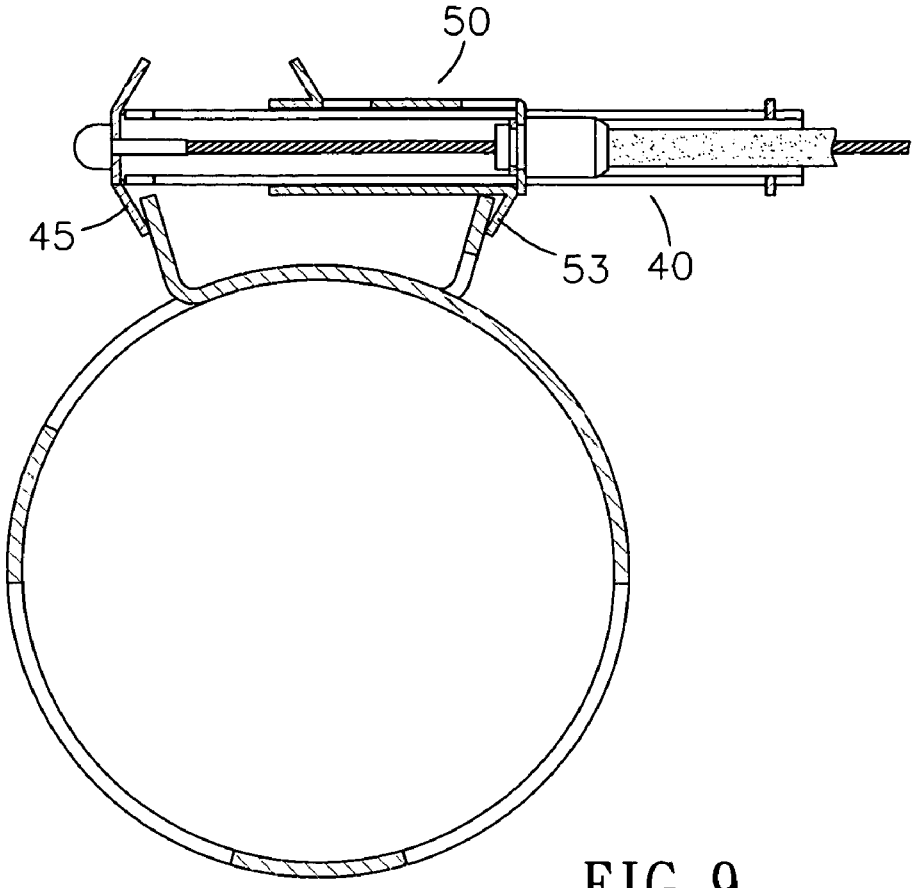
FIGS. 9 and 10 respectively show the unfastening device in FIG. 8 is used to unfasten two fasteners of different sizes.
Figure 10:
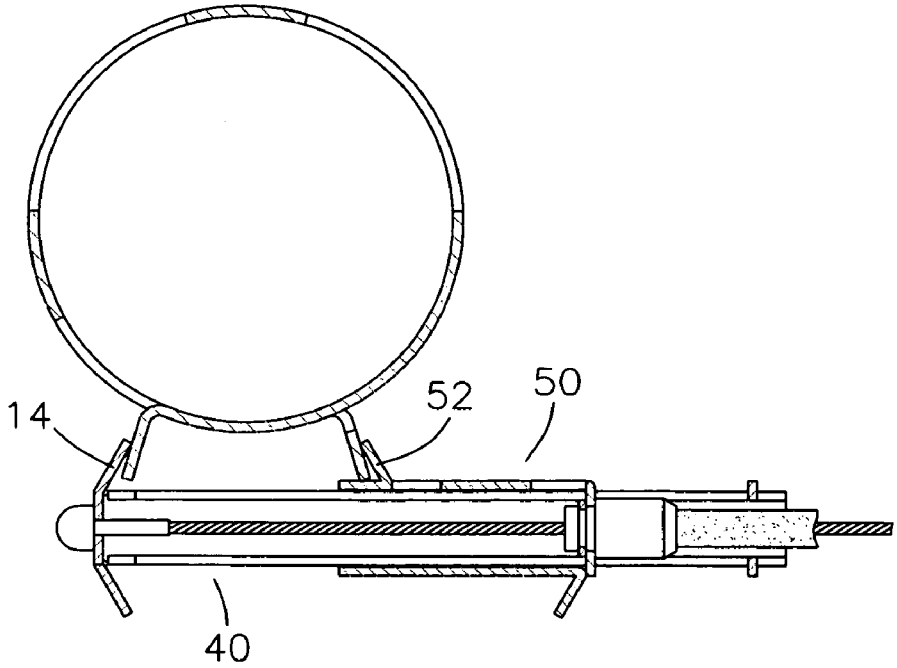

FIG. 8 shows that the base 40 includes a fourth clamp plate 45 extends from an underside of the first end of the base 40 and a fifth clamp plate 53 extends from an underside of the movable member 50. Only one sixth clamp plate 52 extends from the top of the movable member 50. The fourth clamp plate 45 and the fifth clamp plate 53 are used to unfasten a fastener with wide apart two ends as shown in FIG. 9. The first clamp plate 14 and the sixth clamp plate 52 are used to unfasten a fastener with close two ends as shown in FIG. 10.

Figure 11:
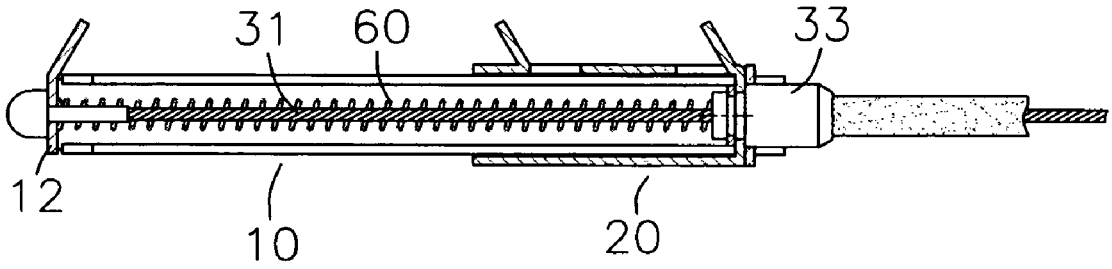
FIG. 11 shows yet another embodiment of the unfastening device of the present invention.

FIG. 11 shows that a spring 60 is mounted to the flexible cable 31 and stopped between the first board 12 and the head 33. By the spring 60, the base 10 and the movable member 20 can be moved back to their original relative positions when the flexible cable 31 is not pulled.

While we have shown and described the embodiment in accordance with the present invention, it should be clear to those skilled in the art that further embodiments may be made without departing from the scope of the present invention.

What is claimed is:

1. An unfastening device for unfastening pipe fasteners, comprising:

a base having a first board, a second board and two sidewalls which are connected between the first and second end boards, a first clamp plate extending from a top of a first end of the base;

a movable member slidably mounted to the base and movable between the first and second boards of the base, a second clamp plate and a third clamp plate extending from a top of the movable member, and a cable unit including a head which extends through the second board and stopped by an end of the movable member, a flexible cable extending through the head and having a first end fixed to the first board of the base.

2. The device as claimed in claim 1, wherein an insertion extends axially from the head and extends through a hole defined in the end of the movable member, a C-shaped clip is mounted to the insertion to position the insertion to the end of the movable member.

3. The device as claimed in claim 1, wherein the second board includes two protrusions on two sides thereof and the sidewalls of the base have two slots through which the two protrusions extend.

4. The device as claimed in claim 1, wherein two apertures are defined in a top of the movable member and respectively located close to the second and third clamp plates.

5. The device as claimed in claim 1, wherein the first end of the flexible cable extends through the first board of the base and is connected to a stop member so that the first end of the flexible cable is fixed to the first board of the base.

6. The device as claimed in claim 1, wherein a fourth clamp plate extends from an underside of the first end of the base and a fifth clamp plate extends from an underside of the movable member.

7. The device as claimed in claim 1, wherein a spring is mounted to the flexible cable and stopped between the first board and the head.

* * * * *